United States Patent [19]

Honigsbaum

[11] Patent Number: 4,646,713

[45] Date of Patent: Mar. 3, 1987

[54] SMOKE-INCINERATING WOODSTOVE

[76] Inventor: Richard F. Honigsbaum, 21 A Barry Gardens, Passaic, N.J. 07055

[21] Appl. No.: 475,357

[22] Filed: Mar. 14, 1983

Related U.S. Application Data

[63] Continuation of Ser. No. 6,581, Jan. 26, 1979, abandoned.

[51] Int. Cl.[4] ..... F24B 5/00; F24C 1/08

[52] U.S. Cl. ..... 126/79; 110/229; 110/231

[58] Field of Search ..... 110/239, 231, 229; 126/79, 121, 374; 201/21, 29; 55/74; 60/39.1 2

[56] References Cited

U.S. PATENT DOCUMENTS 110,664 1/1871 Martin ..... 126/79

787,941 4/1905 Phillippe et al. ..... 126/79

1,629,223 5/1927 Mogyoros et al. ..... 126/79

1,683,730 9/1928 Russell ..... 126/79

*Primary Examiner*—Larry Jones

*Attorney, Agent, or Firm*—Stiefel, Gross, Kurland & Pavane

[57] ABSTRACT

An improved process of the type wherein a fuel is first pyrolyzed in a chamber and the resulting volatiles and non-volatiles then transferred to a combustion region for burning, the improvement comprising temporarily storing at least a portion of the volatiles in an enclosure spaced from the chamber and the combustion region when volatiles production exceeds the volatiles incineration capability of the combustion region. Apparatus for carrying out the method of the invention is also disclosed.

17 Claims, 6 Drawing Figures

SMOKE-INCINERATING WOODSTOVE

This is a continuation, of application Ser. No. 006,581, filed 1/26/79, now abandoned.

BACKGROUND OF THE INVENTION

1. Field of the Invention

This invention pertains to stoves and more particularly to stoves capable of incinerating volatiles.

2. Statement of the Prior Art

The increased demand for wood as a fuel has resulted in the now familiar problems of cost, conservation, and pollution, all of which are at least partially alleviated by increasing the efficiency of the combustion process and apparatus.

While it has long been recognized that the key to efficient burning of wood and similar solid fuels rich in volatiles is effective incineration of these volatiles, peaks in the rate at which these volatiles are released have been ignored, with the result that fuel is wasted and pollution increased because prior art apparatus are incapable of incinerating all of the volatiles released during these peak periods.

The resulting waste and pollution is particularly severe in home heating applications where combustion is a batch process in which a substantial quantity of fuel is allowed to burn before refueling.

Most of the prior art dates back to when solid fuels were the dominant fuels for home heating. Typical of early attempts at volatiles incineration is U.S. Pat. No. 268,682 issued to Jackson, in which a portion of the airborne combustion products are recycled through the combustion chamber. Such arrangements are ineffective because the airborne combustion products are too dilute to burn, and are instead carried up the flue by the through-air flow needed to sustain combustion.

Sherman, in U.S. Pat. No. 768,082, tried to improve matters by separating airborne combustion products into fractions to be recycled and fractions to be discharged into the flue, but his separation means is ineffective.

Jones and Shephard, in U.S. Pat. No. 921,612, disclose a stove having a coking chamber with an "airtight" top, the coking chamber being heated by and discharging into a surrounding combustion chamber. This arrangement is a definite improvement because the gases which are the primary pollutants exit the coking chamber at concentrations high enough to burn. A somewhat similar arrangement is disclosed by McMaster in U.S. Pat. No. 963,631. Unfortunately, both of these arrangements have limited coking capability because there is no throughflow in the coking chamber. Pollard introduces through-flow in U.S. Pat. No. 969,117.

More recent examples of recycling arrangements include Schwartzkopf, U.S. Pat. No. 2,172,715, Day, U.S. Pat. No. 2,556,840 and Van Raden, U.S. Pat. No. 3,754,869. However, like the prior art patents cited above, they do not take into account peaks in the production of volatiles.

SUMMARY OF THE INVENTION

Recognizing that the major defect of the prior art is the inability to incinerate volatiles when volatiles production peaks, I have invented an improved combustion process in which volatiles are temporarily stored during production peaks for subsequent incineration. I have also invented an apparatus for carrying out the method. The very important benefits of such an invention with respect to efficiency and pollution are obvious.

In the preferred embodiment of my apparatus for carrying out the method, the fuel is heated in a pyrolytic conversion chamber substantially void of free oxygen and the resulting volatiles are released into the chamber. The products of the pyrolytic conversion are then transferred to a pyrolytic products combustion region on a demand basis, the volatiles and non-volatiles following separate paths, but each preferably being transferred by gravity. A temporary storage device, which is interposed in the volatiles path, reduces the incineration load to manageable levels preferably by condensing certain volatiles out of the volatiles stream, the condensate being stored in a reservoir for subsequent transfer to the combustion region. This method of storage is preferred not only because the volume required for storage of these volatiles in vapor form is excessive, but also because the heat released during volatiles condensation offsets the reduced heating capability which results when a substantial portion of the heat of combustion of the fuel is absorbed by the vaporizing volatiles.

In the basic embodiment, the condensate is vaporized and transferred to the combustion region in gaseous form when excess incinerating capability is available. Often, however, a large fraction of the condensate is water, which has a high heat of vaporization and does not burn. The fraction of the condensate comprising water will be high, for example, when wood and similar fuels are used. To increase efficiency when such fuels are used, I have also developed a modified temporary storage device which extracts the water fraction and makes it available for disposal in liquid form, thus diverting to useful purpose the heat of vaporization which would otherwise be lost.

In still another embodiment, the stove is convertible to a fireplace. While this embodiment is less efficient as a fireplace than as a stove, it is far more efficient than conventional fireplaces or even conventional convertible stoves operating in the fireplace mode because the embodiment of this invention includes the temporary storage device. These and other features and modifications of the invention are more fully explained in the following detailed description and drawings of the preferred embodiments thereof.

DETAILED DESCRIPTION OF THE PREFERRED EMBODIMENTS

Figure 2:
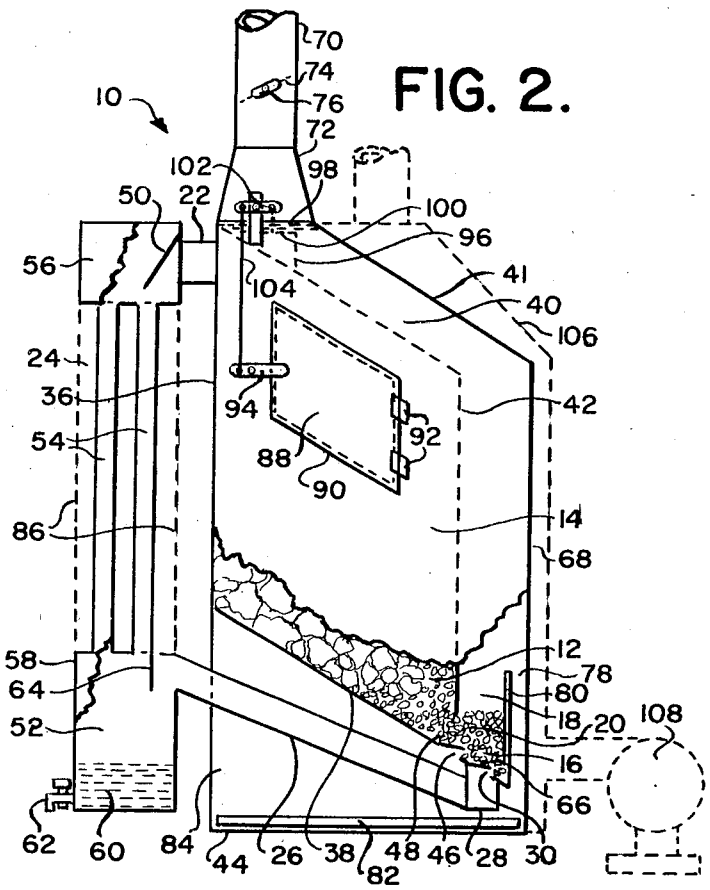
FIG. 2 is a side elevation of the embodiment shown in FIG. 1 with a portion cut away to show internal features.
Figure 1:
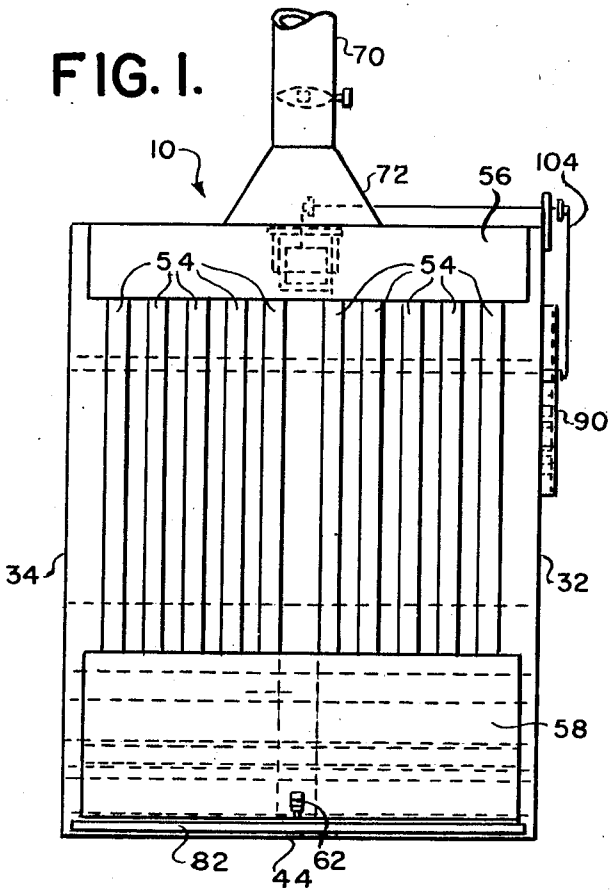
FIG. 1 is a rear elevation illustrating the basic embodiment of a stove in accordance with the present invention.

Referring first to FIGS. 1 and 2, the preferred basic embodiment of an apparatus for carrying out the method of the invention is generally designated 10. As shown, a fuel 12 is heated in a pyrolytic conversion chamber 14. The non-volatiles 16 which result are conveyed by gravity to a pyrolytic products combustion region 18 via a slot 20, while the volatiles are conveyed to combustion region 18 along a path defined by duct 22, temporary storage device 24, duct 26, manifold 28 and slot 30.

As used herein throughout, the terms "fuel" and "solid fuel" refer to the conventional list of solid fuels including wood, peat, lignite, coal, and products and by-products thereof, to which may be added occasional quantities of refuse, waste, and garbage in natural and processed form. This list can be expanded to include other renewable or fossilized fractions of the biomass, solidified where necessary. The apparatus of this invention can also be used to effect odor-free incineration of occasional quantities of human waste. Similarly, the terms "volatiles" and "non-volatiles" have the meanings commonly associated with combustion in stoves, fireplaces, etc. Thus, "volatiles" include not only gases and vapors, but also other fuel and fuel product fractions transported thereby, while "non-volatiles" include not only solids, but also other fuel and fuel product fractions transported thereby. It should be further understood that the term "low temperature volatiles" refers to those volatiles having boiling points below the boiling point of water while "high temperature volatiles" refers to those volatiles having boiling points above the boiling point of water. Also, the term "furnace" is used here to distinguish central heating apparatus from stoves, fireplaces, etc., and as such includes both boilers and furnaces as the terms are commonly used.

In the embodiment of FIGS. 1 and 2, the pyrolytic conversion chamber 14 is defined by a pair of side walls 32 and 34, a rear wall 36, a bottom panel 38 which extends downwardly from rear wall 36 between side walls 32 and 34, a top partition 40 and a front partition 42. The partition 42 is common to both chamber 14 and combustion region 18 and defines the upper boundary of the non-volatiles transfer slot 20. The bottom panel 38 of the chamber 14 is extended to form the bottom of the combustion region 18. The side walls 32 and 34 and rear wall 36 extend below bottom panel 38 and are suitably joined to the bottom 44 of the apparatus 10. These walls, partitions, panels, etc. are preferably made of cast iron, steel plate, or other materials used to make stoves, furnaces, and the like, such materials being well known to those skilled in the art. Likewise, they may be joined together using any of a number of well known techniques. Refractory linings can be added where desired.

Pyrolytic conversion in chamber 14 is effected by combustion which is sustained by air entering a slot 46 and by heat which is conducted from combustion region 18 via the partition 42. A baffle 48 above the slot 46 keeps fuel and ash from clogging the slot. While other locations of the slot 46 are possible, as presently preferred and shown, the slot 46 is directly below the non-volatiles transfer slot 20. When this location is used, air admitted in excess of that needed in chamber 14 is diverted to combustion region 18 instead of overloading chamber 14 with volatiles as would be the case if the slot 46 were located elsewhere. In order for slot 46 to serve as desired, it is obvious that chamber 14 should be substantially gas-tight except for the gas passages specifically mentioned herein.

Because the partition 42 is heated while the rear wall 36 is not, an internal circulation results in chamber 14 which heats the entire charge of fuel. This circulation is aided by the incline of top partition 40, and to some degree by the incline of bottom panel 38. The primary reason for inclining bottom panel 38, however, is to effect the gravity transfer of the non-volatiles 16 to the combustion region 18 as described above.

The flow of volatiles out of the chamber 14 via duct 22 is preferably controlled by a throttling device, here shown to be a manually controlled damper 50. After passing through the duct 22, the volatiles flow into the temporary storage device 24 which, as presently preferred and shown, comprises a condenser cooled by the medium to be heated (in this case air), and a reservoir 52 for collecting the condensate, the reservoir being arranged so that the condensate therein can be evaporated by elevating the temperature of the volatiles stream. The condenser portion preferably comprises a collection of vertically oriented tubes 54 extending between a top manifold 56 and a bottom manifold 58, top manifold 56 being fed by the duct 22. As preferred and shown, bottom manifold 58 is enlarged and also serves as the reservoir for the condensate 60 which forms as the volatiles pass through the tubes 54. As will be more fully understood hereinafter, the condensate 60 can be drained by, for example, a petcock 62, or evaporated and returned to the volatiles stream. As preferred and shown, a baffle 64 is preferably arranged between the tubes 54 and the manifold 58 to direct the volatiles stream over the condensate pool 60, thereby effecting evaporation of the condensate when the temperature of the volatiles stream is elevated. The volatiles which leave the bottom manifold 58 via connected duct 26 flow into the distribution manifold 28 beneath the combustion region 18 and then enter the combustion region via the slot 30. Preferably, the slot 30 and the manifold 28 are kept free of non-volatiles and ash by a baffle 66.

As noted above, the non-volatiles are transported to the combustion region 18 along the inclined bottom panel 38 under the influence of gravity. The condenser portion of the preferred basic embodiment also relies on gravity for maintaining the desired volatiles flow. Thus, because the gaseous components of the volatiles stream become more dense as they are cooled, they fall downward in the tubes 54 toward the duct 26 under the influence of gravity. Assuming the condenser coolant flow is naturally induced, the result is a heat exchanger of the preferred counter-flow type. This flow relation is preferably maintained when flow is forced.

The pyrolytic products combustion region 18 is defined by the side walls 32 and 34, the partition 42, the bottom panel 38, and the front wall 68. As shown, the combustion region 18 is connected to a flue 70 by a passage formed by side walls 32 and 34, inclined top partition 40, inclined top panel 41 and a reducer 72. Preferably, flow through the flue 70 is throttled by, for example, a manually controlled damper 74 actuated by a handle 76. Following conventional practice, flue 70 is, of course, connected to a chimney, etc. Since the details of such a connection are well known to persons skilled in the art, the chimney and connecting details are omitted here.

Combustion in the pyrolytic products combustion region 18 is characterized by excess air, i.e. enough air to consume both volatile and non-volatile combustibles. This air is admitted into the region 18 via the slot 46 and via a passage 78 between the front wall 68 and the vertical grate 80 which serves as a stop for the non-volatiles sliding down the inclined bottom panel 38. Additional openings can, of course, be cut into wall 68 and elsewhere as required.

Combustion in region 18 involves both volatiles and non-volatiles. As noted above, the non-volatiles enter region 18 via the non-volatiles transfer slot 20, and during transfer pass over the air slot 46. Thus, combustible non-volatiles exit the chamber 14 and enter the region 18 as glowing coals and are consumed therein. The non-combustible non-volatiles which result fall through openings in grate 80 provided for this purpose and may be collected, for example, in an ash pan 82 at the bottom of the apparatus 10. Persons skilled in the art will appreciate that the arrangement disclosed for eliminating non-combustible, non-volatiles applies to wood and similar fuels which leave a relatively fine ash. These persons will also recognize that when fuels which leave large ash components (also known as "clinkers") are burned, shaker grates may be required.

The volatiles are introduced into the mass of burning non-volatiles via the slot 30, and are heated to ignition temperature by that mass. As these volatiles exit above the burning mass of non-volatiles they are consumed. As noted above, sufficient combustion air to consume the volatiles enters the region 18 via the slot 46 and the passage 78, which preferably communicate with outside air via an opening 84 in the portion of the rear wall 36 beneath the bottom panel 38. The opening 84 also accommodates removal of the ash pan 82.

The primary feature of the stove 10 is the temporary storage device 24. For explanation purposes only, it is convenient to assume that the combustion apparatus 10 is a wood burning stove intended for space heating. In order to focus attention on the temporary storage device, assume further that the stove 10 has been burning long enough to sustain a mass of burning coals in both chamber 14 and region 18, that outside ambients are low enough so that space heating is desired, and that the stove has been recently refueled.

Since fresh fuel contains considerable moisture even when well seasoned, the period following refueling is characterized by substantial moisture release. The moisture is released as vapor and the heat of vaporization is supplied by the combustion of the fuel. In a conventional stove this vapor travels up the flue and the heat of vaporization therein is lost. In the stove of this invention, however, the vapor enters the temporary storage device 24 where, as described above, it is condensed, the heat released during the change of state being used for space heating. Furthermore, in a conventional stove the moisture release during combustion cools and dilutes combustible volatiles to temperatures and concentrations below ignition levels with the result that these combustibles exit the flue, wasting fuel and polluting the air. In the stove of this invention, however, moisture is retained in the temporary storage device 24, and combustible volatiles which are not condensed are transported to combustion region 18 where they are burned. These two benefits combine to make the stove of this invention a more effective heater in the interval following refueling than prior art stoves.

While the period following refueling is characterized by volatiles production at a rate which exceeds the rate at which volatiles can be incinerated, the period preceding refueling is characterized by a volatiles incineration capability in excess of production, and during this period the volatiles previously condensed and stored are evaporated and then incinerated in the combustion region 18. As explained earlier, evaporation is effected by raising the temperature of the volatiles stream which, in the preferred basic embodiment 10, is accomplished by opening the damper 50 thereby bringing hot volatiles into contact with the condensate 60. Manually operable louvers 86 about the tubes 54 may be included as an option and closed when volatiles evaporation is desired.

During this phase of operation both combustibles and non-combustibles are evaporated, and it is preferable to arrange matters such that a combustible volatiles stream will incinerate volatiles not incinerated by the burning charcoal. Assuming the depth of fuel in the chamber 14 over the slot 46 to be in excess of about three inches, the volatiles stream is rendered combustible by the combustible gases produced in the reduction and distillation zones of the fuel bed. This effect is augmented by a similar effect in the region 18. (This matter of combustible gas production is known to persons skilled in the art and detailed in U.S. Bureau of Mines Bulletins 135 dated 1917, and 378 dated 1934. The matter of dilution is also known to such persons, and is detailed in Forest Products Laboratory Report 2136 dated 1958.)

Having detailed the operation of temporary storage device 24, it is now appropriate to suggest materials of construction which will not only resist attack by the volatiles, but, in the case of tubes 54, will also effect the desired heat transfer. Among the choices are cast iron, copper and copper alloys, and corrosion resistant steels. This list can be expanded by adding protective coatings and by recognizing the option of making the walls thick enough to survive attack.

A final matter to be considered is that of refueling. Preferably, refueling is effected via a refueling port 88 which is accessed by opening a refueling door 90. As presently preferred and shown, door 90 pivots on hinges 92, is held closed by a latch 94, and is rendered gastight when closed by sealing means (not shown) familar on prior art stoves.

In order to avoid polluting the heated space during refueling, the apparatus 10 is preferably provided with a bypass 96 which communicates with the pyrolytic conversion chamber 14 and discharges into the reducer 72. This bypass 96 is closed during normal operation, preferably by a sealing arrangement more effective than a conventional damper. For example, a weighted cover 98 having a resilient member (not shown) mating with the machined upper lip 100 of the bypass 96 may be employed. This arrangement, familiar on doors of prior art stoves and preferred on door 90 here, cooperatively combines labyrinth, resilient gasket, and machined mating surface sealing. This bypass is preferably held closed by gravity and opened manually by means of the simple mechanical linkage 102 shown. An optional convenience feature is a link 104 which actuates the cover 98 "automatically" when the latch 94 is operated to open the door 90.

Having now described the basic embodiment for carrying out the method of my invention, those skilled in the art will appreciate that the apparatus 10 may be modified for applications other than as a natural convection space heater. For example, apparatus 10 be-comes a natural convection hot air furnace when shroud and ducts 106 (a portion of which are shown by dotted lines in FIG. 2) are added, a forced air furnace when a blower 108 is added, and a steam or hot water furnace when suitable water jackets, coils, and pipes (represented by shroud and ducts 106) are added. By making the top panel 41 and partition 40 horizontal, the apparatus 10 may be used for cooking as well as heating. The details of such conversions are omitted for clarity of illustration and because they are deemed obvious to persons skilled in the art.

Figure 3:
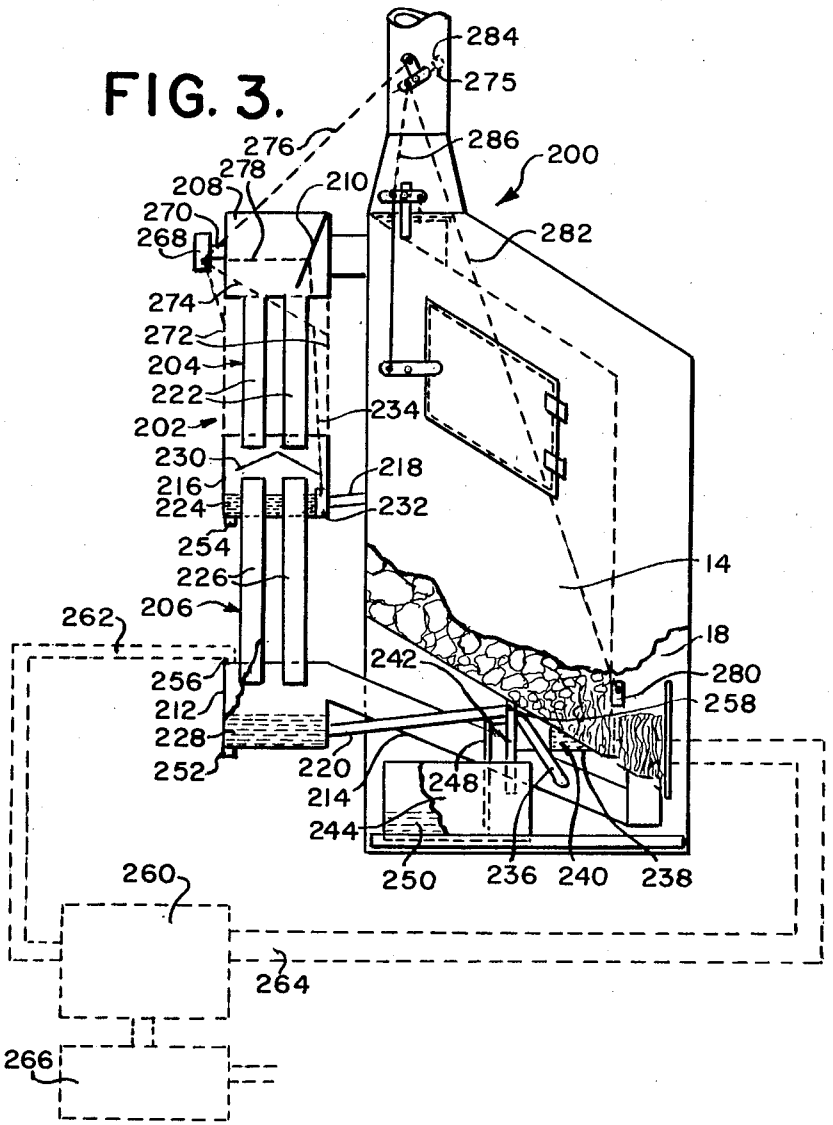
FIG. 3 is a side elevation similar to FIG. 2 but showing an embodiment having an improved temporary storage device and automatic temperature and draft control.

Referring now to FIG. 3, a modified version 200 of the apparatus 10 illustrated in FIGS. 1 and 2 is shown. The apparatus 200 incorporates several features not found in the basic embodiment. These include an improved temporary storage device, an automatic draft control, and automatic temperature sensing and control. The embodiment of FIG. 3 also includes many features explained in detail in the description of the basic embodiment. As to the common features, no further description is deemed necessary and none is provided.

Consider first the improved temporary storage device 202 which has an upper portion 204 and a lower portion 206. Familiar parts from the embodiment of FIGS. 1 and 2 include top manifold 208, throttling device 210, bottom manifold 212, and duct 214. Center manifold 216 is new as are the small pipes 218 and 220 which exit the center and bottom manifolds, respectively.

Volatiles enter the temporary storage device 202 as previously, and are distributed amongst tubes 222 where selected fractions are condensed, the condensate 224 being collected in the bottom of the center manifold 216. Volatiles which are not condensed in the tubes 222 flow through manifold 216 and enter tubes 226 where additional cooling occurs and additional volatiles fractions condense, these fractions 228 collecting in the bottom of the bottom manifold 212. Volatiles which survive this second condensation follow a path through duct 214 as is more fully described above in connection with the embodiment 10 of FIGS. 1 and 2.

Center manifold 216 has special features to effect separation of condensed and non-condensed volatiles. These features include tubes 222 which extend into the manifold 216 to drip condensate on to a baffle 230, and tubes 226 which extend into manifold 216 above the level of the condensate 224 therein and are shielded from the drip from tubes 222 by the baffle 230. Center manifold 216 also houses a temperature sensing actuator 232 which may comprise, for example, a bimetallic element. The actuator 232 senses the temperature of the condensate 224 and actuates throttling device 210 via link 234, the actuator being calibrated to maintain the temperature of the condensate 224 a few degrees above the boiling point of water. The center manifold 216 is also fitted with an overflow pipe 218 which returns excess condensate 224 to the pyrolytic conversion chamber. The portion of this returned condensate which does not vaporize in the pyrolytic conversion chamber 14 follows a path down the rear wall and along the bottom of the pyrolytic conversion chamber where some or all of it is incinerated. Any remaining condensate flows into the combustion region 18 and is incinerated therein. The vaporized portion of the returned condensate 224 recycles through temporary storage device 202. Persons skilled in the art will recognize that gas or vapor exchange between the pyrolytic conversion chamber and the manifold 216 via the pipe 218 is avoided by tilting pipe 218 upward from manifold 216 with respect to the horizontal as shown, thereby establishing a liquid seal.

When actuator 232 is in control, it is clear that condensate 224 is substantially free of water, while condensate 228 is a mixture of water and other vapors which condense in the temperature range established by the set point of actuator 232 and the temperature of tubes 222. As shown, a further separation of the condensate 228 may be effected in a rectifier 238 to which the condensate 228 is transferred by the pipe 220, this pipe also being tilted to serve as a liquid seal as is explained above with respect to the pipe 218. As presently preferred and shown, rectifier 238 is attached to the underside of the bottom of the pyrolytic conversion chamber where it is heated by conduction from the heat generated in the pyrolytic conversion chamber during combustion. Conductive heating of the rectifier 238 also heats the condensate 240 therein whereupon the lower temperature volatiles are vaporized and returned to the volatiles stream via a pipe 236. The avoid boiling of the water in rectifier 238, and the resulting waste of heat and the dilution which results when water vapor enters duct 214 via pipe 236, rectifier 238 also preferably houses a temperature sensing valve 242 which opens to drain condensate 240 into a sump 244 when rectifier temperature approach the boiling point of water. Rectifier 238 is also preferably fitted with an overflow pipe 248 having one end communicating with the rectifier just below the rectifier end of pipe 236 and the other end immersed in the waste 250 in sump 244 to maintain a liquid seal. The waste 250 in sump 244 is, of course, primarily water, but may include other condensates having boiling points at or near the boiling point of water. Sump 244 may be emptied manually, or by connection via an overflow to a suitable drain. It is therefore apparent that the improved temporary storage device 202 separates water from the other volatiles, making the water available for disposal in liquid form while the other volatiles are transported to combustion regions for incineration. This is an obvious improvement over the basic embodiment of FIGS. 1 and 2 where one must choose between discarding the raw condensate and the combustibles contained therein in order to save the heat of vaporization of the water, or wasting the heat of vaporization of the water in order to recover the combustibles in the raw condensate. Furthermore, the heat which results from incineration of condensed combustibles is available earlier in, and over a longer portion of, the fuel cycle and not just during the evaporation phase of operation as is the case in the embodiment of FIGS. 1 and 2.

Since the gaseous stream which flows through tubes 226 is saturated with water vapor during at least a portion of the fuel cycle when wood and similar fuels are used, it is clear that additional water can be removed from the volatiles stream by lowering the temperature of tubes 226, and that the benefits which result therefrom are not compromised by the low temperature combustible volatiles also condensed thereby because these volatiles are recovered in the rectifier. In order to lower the temperature of tubes 226, these tubes are preferably left uncovered as shown, or shielded mechanically in such a way that the room air or other medium to which the heat from these tubes is rejected has free access to these tubes. Adjustable louvers 272 of this embodiment preferably serve only the upper tubes 222, and by so doing also regulate the rate at which heat is rejected from the lower tubes because when the louvers 272 are closed, temperatures in the center manifold rise and actuator 232 closes throttling device 210, reducing the volatiles flow through both the upper and lower tubes, and the heat rejected therefrom.

The temporary storage device 202 of FIG. 3 preferably includes drain plugs 252 and 254 which are removed to drain their respective manifolds 212 and 216 at the end of the heating season, or to divert condensate to other uses as, for example, separation into fractions in a separate apparatus, some of these fractions being usable as fuels in internal combustion engines. When removal for subsequent use is contemplated, it may be more convenient to replace these plugs with draincocks or the like. Additional plugs, draincocks or similar arrangements can, of course, be provided elsewhere in the volatiles path. For example, the location of plug 256, where a gas which is normally combustible may be drawn, is particularly interesting as is that of plug 258 where low temperature volatiles such as methyl alcohol are found.

Gas removed through the plug 256 can, for example, be used to fuel the optional energy conversion system shown by dotted lines in FIG. 3. In this example, the gas is supplied to a single or multi-fuel prime-mover (internal combustion engine, gas turbine, etc.) 260 via a conduit 262, the exhaust from the prime-mover is introduced into the mass of glowing coals in the pyrolytic products combustion region by a conduit 264, and the mechanical output of the prime-mover is used to drive an energy conversion device 266 which, in the case of co-generation, is an electric generator.

In such applications, particularly when the heat production from the stove 200 and the output from the energy conversion device 266 are both regulated automatically, there may be times when the fuel requirements of the prime-mover exceed the fuel production capability of the pyrolytic conversion chamber. At such times, and because of the particular arrangement of the preferred embodiment in which the coal bed is interposed between the combustion air supply and the manifold which feeds the gaseous efflux of duct 214 into the bed, the required additional fuel is produced by the reversed gas flow through the bed which results when fuel at the required rate is drawn at plug 256. This particular arrangement of the preferred embodiment is also a safety feature because free oxygen and the resulting explosive mixtures in portions of the volatiles flow path as a result of flow reversal are eliminated thereby. This safety features has its counterpart in the pyrolytic conversion chamber where the non-volatiles collect in the portion of that chamber between the combustion air openings and the volatiles.

These arrangements in which the non-volatiles portion of both the pyrolytic conversion chamber and the pyrolytic products combustion chamber are interposed between the respective combustion air openings and the volatiles path are common to and preferred in all the embodiments herein because they eliminate the hazards of free oxygen in the volatiles path. Such hazards result, for example, when air is pre-mixed with the volatiles in the manifold corresponding to 28 of FIG. 2, or where volatiles are introduced into the pyrolytic products combustion chamber above instead of below the mass of burning coals.

The relationship between the stove 200 and the prime-mover 260 is symbiotic because the stove converts the solid fuel into a form suited to the prime-mover and processes the exhaust from the prime-mover to reduce the pollution therefrom, while the waste heat from the prime-mover helps to heat the space heated by the stove. The relationship is also synergistic because the "waste" heat, which normally accounts for at least two thirds of the energy input of the prime-mover is now used for space heating, and the additional fuel required for the combination is merely that represented by the engine output. In the case of the co-generator, the additional fuel requirement is substantially nil since the most common electrical appliances (lights, refrigerators, etc.) convert substantially all their input into heat released into the space served by the stove.

While the arrangement shown, in which the apparatus processes both fuel and exhaust is preferred, it is clear that the combination will be both symbiotic and synergistic when the energy conversion system is fueled as shown and exhausted conventionally, or when fueled conventionally but exhausted as shown.

The embodiment of FIG. 3 also features automatic temperature control of the space to be heated. As shown, a temperature sensing actuator 268 (which is the functional equivalent of the thermostat in a conventional heating system) is mounted at a convenient location as, for example, on a thermally insulated stem 270 attached to the manifold 208. When additional heat is required, actuator 268 opens louvers 272 by means of links 274, and damper 275 by means of a link 276. Upon opening of damper 275, additional heat is available from the pyrolytic products combustion region almost instantaneously as the burning fuel responds to the increased draft. Additional heat from the temporary storage device 202 may, however, be delayed. This delay, which results because the temperature of condensate 224 must drop before the actuator 232 can respond, can be eliminated by adding an optional link 278 between actuator 268 and throttling device 210 to effect opening of the throttling device 210 when additional heat is required. In order to avoid interference between the actuators 232 and 268, the link 278 is preferably a cable, chain, or similar "tension only" member such that actuator 268 opens throttling device 210 only when more heat is required, and actuator 232 is in control otherwise.

Another temperature sensing actuator 280 for actuating damper 275 by means of a link 282 may be added to maintain the temperature of the gas stream exiting the non-volatile mass in the pyrolytic products combustion region at a level which assures incineration of the volatiles. In order to avoid interference between this optional anti-pollution feature and actuator 268, both links 276 and 282 are preferably "tension only" members arranged to open the damper 275 on both an "OR" and "AND" basis, and to accommodate the closing of damper 275 on a "NOR" basis. Closing can be effected for example, by a spring, or, as preferred and shown, by gravity acting on a weight 284. If these optional features are included,it is also convenient to add another "tension only" line 286 to open the damper 275 "automatically" upon opening of the access door during refueling.

With respect to damper 275, throttling device 210, and the weighted cover corresponding to 98 of FIG. 1, persons skilled in the art will recognize that these flow regulating elements are so arranged that a break in the respective linkages will, as a safety feature, result in minimum heat production and/or failure to respond to a demand for more heat. Where codes so require, linkages, flow regulating elements, and sensors can, of course, be rearranged so that linkage failure results in unobstructed flow. Details of the rearrangement are omitted here because persons skilled in the art can supply these details once the flow requirements are known.

Figure 4:
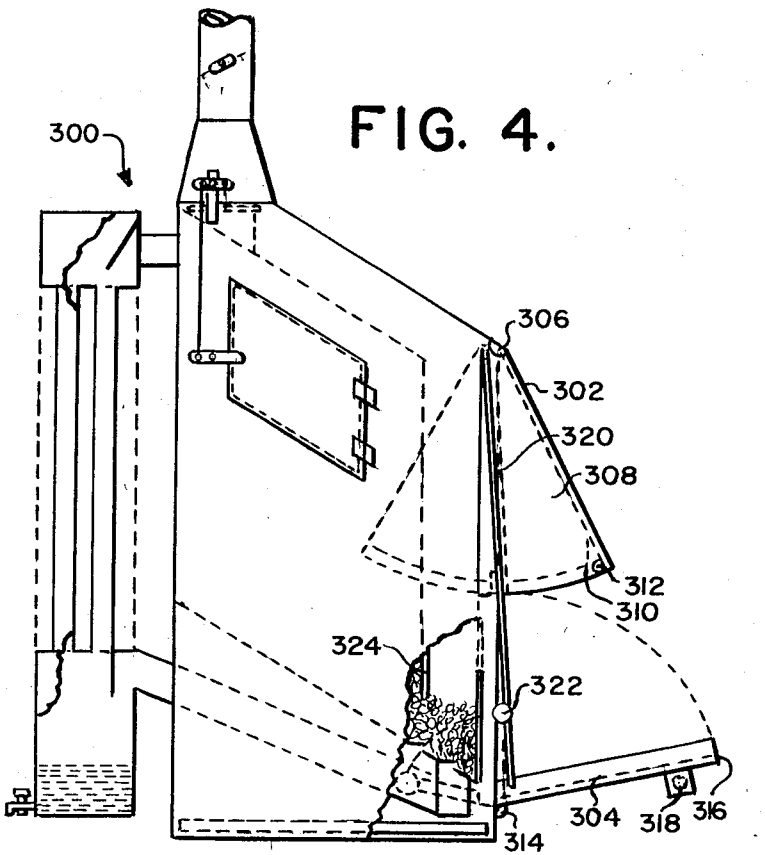
FIG. 4 is a side elevation similar to FIG. 2 illustrating a stove embodiment convertible to a fireplace.

Referring now to FIG. 4, the stove 300 illustrated therein is in all respects identical to the stove 10 of FIGS. 1 and 2 except that the front wall has been modified to accommodate direct viewing of the combustion processes in the pyrolytic products combustion region, and "wrap-around" doors 302 and 304, which convert the stove to a fireplace, and vice versa, have been added.

As shown, the upper door 302 pivots on a hinge 306, and when open as shown (solid lines), serves as the fireplace hood. The bottom portion 308 of upper door 302 is shaped to form a drip lip 310, and the female portion 312 of a labyrinth seal. The lower door 304 pivots on a hinge 314, and when open as shown (solid lines), serves as the fireplace hearth. The upper edge 316 of lower door 304 is the male portion of a labyrinth seal which mates with female portion 312 when doors 302 and 304 are closed. Of course, similar arrangements, or others familiar to persons skilled in the art, can be used to seal the doors to the stove when these doors are closed.

Since doors 302, 304 can be expected to be too hot to touch when the stove is in operation, lower door 304 is preferably fitted with a handle 318 and the doors are connected to one another by a link 320 in such a way that both open and close simultaneously. Since the details of such linkages are well known to persons skilled in the art, they have been omitted here for purposes of clarity. The doors are preferably held opened or closed by gravity using, for example, the arrangement shown wherein door 304 dominates weight 322 when open, and vice versa. While this arrangement is preferred, alternate arrangements, not only for opening and closing, but for the doors themselves, may be used, such alternate arrangements being known to persons skilled in the art and familiar in prior art devices.

While this simple modification is obvious once the basic embodiment is known, it is important because of the improvement in efficiency and pollution when compared with prior art fireplaces and combination stove-fireplaces operating in the fireplace mode thanks to the temporary storage device. Additional improvement will result if the improved temporary storage device of the FIG. 3 embodiment is incorporated into the embodiment of FIG. 4. This borrowing of features is, of course, not limited to the example cited, nor is it limited to the features recited herein. Thus, the embodiment of FIG. 4 can be converted to a hot air furnace by adding appropriate portions of the enclosure 106 of the stove 10 of FIGS. 1 and 2, and heat transfer can be improved by ribbing, finning, corrugating, etc. A further modification, and one which may be preferred for particular applications, is one in which the apparatus is "built in" as are conventional fireplaces.

An optional convenience feature of the embodiment of FIG. 4 is a guillotine type door 324 and adjusting means (not shown). This feature is used to adjust the vertical dimension of the non-volatiles transfer slot and thus the depth of, and heat produced by, the burning non-volatiles adjacent the vertical grate, and thus permits direct viewing in comfort when temperatures are mild. Alternate arrangements effecting the same result can, of course, be substituted.

Figure 6:
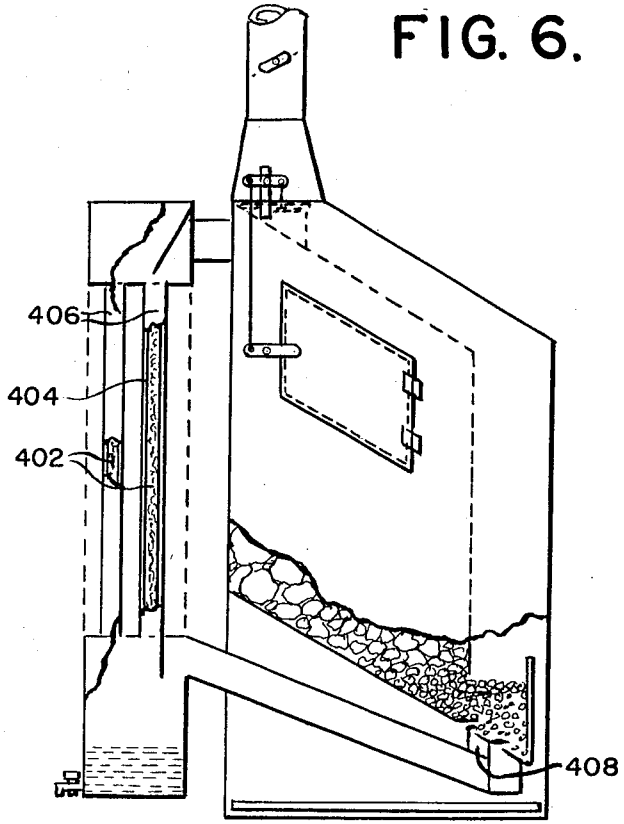
FIG. 6 is a side elevation similar to FIG. 2 illustrating an embodiment having auxiliary fuel capability and an alternative temporary storage device.
Figure 5:
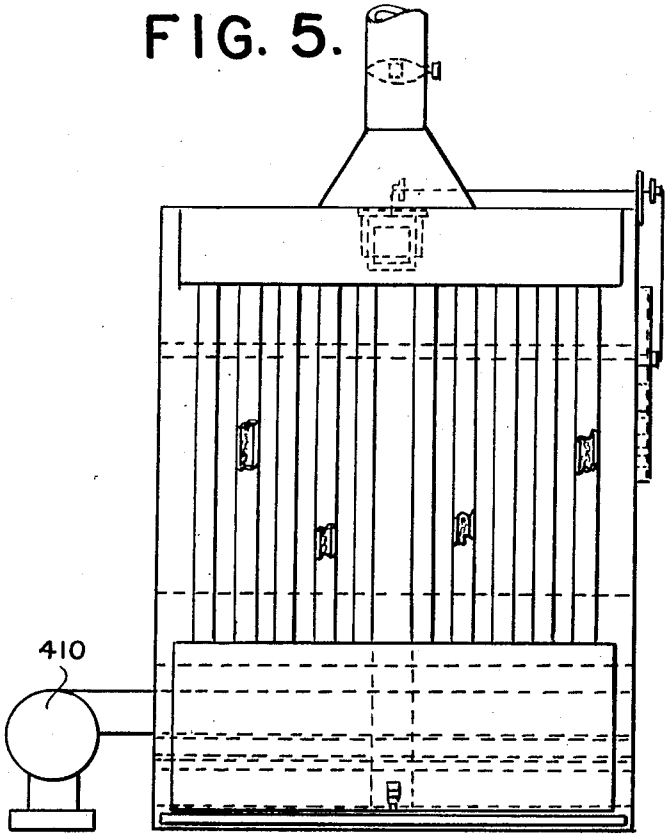
FIG. 5 is a rear elevation similar to FIG. 1 showing an embodiment having auxiliary fuel capability.

Referring now to the embodiment of FIGS. 5 and 6, several features not included in the previous embodiments are shown. One of these is adsorption columns 402, preferably loosely packed, housed in perforated tubes 404, and suspended in heat exchanger tubes 406 in such a way that tubes 404 do not touch the walls of tubes 406. These adsorption columns 402, which may be comprised of activated charcoal, silica gel, etc. serve as temporary storage devices which are regenerated by elevating the temperature of the volatiles stream. While these columns are effective when new, they are eventually compromised by use and, therefore, the temporary storage arrangements of FIGS. 1–4 are preferred. When such columns are used, the arrangement shown in FIGS. 5 and 6 is preferred because the columns are housed in such a way that the housing serves as an effective temporary storage device when the columns do not.

Gas jet manifold 408 and oil burner 410 are alternate auxiliary fuel devices for providing heat when there is no primary fuel in the combustion apparatus. These devices may be actuated manually or automatically as desired, the details of the actuator being omitted for purposes of clarity and because they are well known to persons skilled in the art. Such devices are preferably fitted where shown so that at least a portion of the heat produced thereby follows the volatiles path through the temporary storage device in order to take advantage of the substantial heat exchange capability of the tubes 406.

Thus, the processes and apparatus of this invention have been described and the preferred embodiments illustrated, the embodiment of FIGS. 1 and 2 as a higher efficiency and lower pollution alternative where conventional solid fuel stoves and furnaces would otherwise be used, the embodiment of FIG. 3 where higher efficiency and automatic temperature and draft control are required, and the embodiment of FIG. 4 where direct viewing is desired. As mentioned earlier, these embodiments are intended to be illustrative rather than limiting, and special embodiments combining features included in or suggested by the figures or the prior art are considered part of this invention if they include temporary storage as practiced herein. Examples of such combinations include FIG. 4 embodiments with auxiliary fuel arrangements as suggested by FIGS. 5 and 6, FIG. 4 embodiments with additional condenser-reservoir stages (for the purpose of extracting particular volatiles fractions), forced volatiles flow, combined space and hot water heaters, and inlet air throttling. In a further refinement, one of the pipes or ducts connecting the temporary storage device to the pyrolytic conversion chamber is a rigid element capable of supporting the temporary storage device, the others being sufficiently flexible to accommodate differential dimensional change during use. A final matter to be considered is that of aesthetic design. While the figures illustrate simple slab-sided configurations readily fabricated from plate, it is clear that the features of this invention can be designed into configurations such as those having curved surfaces, rounded corners and edges, and axes as well as (additional) planes of symmetry.

Since these as well as other modifications and changes are intended to be within the scope of the present invention, the above description should be construed as illustrative and not in a limiting sense, the scope of the invention being defined by the following claims.

What is claimed is:

1. A stove for the efficient combustion of wood comprising:

a pyrolitic conversion chamber for receiving the wood fuel during a refueling periods, means for generating a controlled draft of air through the fuel in said chamber and means for heating the fuel in said chamber in the presence of the controlled draft of air to generate a volatiles stream of water vapor and other volatile components, and an essentially volatiles free wood fuel;

a combustion region separate from the pryolitic conversion chamber having a means for generating a controlled draft of combustion air therethrough;

means for transferring the essentially volatiles free wood fuel from said pyrolitic conversion chamber to said combustion region;

a temporary storage device including condensing means for separating said volatiles stream into a condensable fraction which includes said water vapor and an uncondensed fraction and temporary storage means for temporarily storing the condensable fraction during an initial period following refueling when said combustion region cannot efficiently incinerate the condensable fraction as fast as the condensable fraction is being generated;

first fluid conduit means for transferring the volatiles stream from said pyrolitic conversion chamber to said temporary storage device;

second fluid conduit means for transferring said uncondensed fraction from said temporary storage device to said combustion region;

means for heating the the stored condensable fraction in said temporary storage means for vaporizing at least a portion of said condensable fraction for transfer through said second fluid conduit means directly into the essentially volatiles free wood fuel in said combustion region; and means for adjusting the amount of heat applied to said condensable fraction by said heating means for controlling the flow rate of the stored condensable fraction from the temporary storage device to the combustion region for supplying an increased amount of said stored condensable fraction to said combustion region during a period preceding refueling when said combustion region can efficiently incinerate the condensed fraction being transferred thereto from the temporary storage device and for supplying a decreased amount of said stored condensable fraction to said combustion region during an initial period following refueling when said combustion region cannot efficiently incinerate the condensable fraction as fast as the condensable fraction is being generated.

2. The stove according to claim 1 wherein the condensing means is disposed above the temporary storage means so that the water vapor and condensable fraction of the other volatile components condensed in the condensing means flow by gravity from the condensing means to the temporary storage means.

3. The stove according to claim 2, wherein the condensing means comprises a first condenser disposed over a reservoir for respectively condensing and receiving a high boiling portion of said volatiles stream having a lowest boiling point exceeding the boiling point of water, and a second condenser disposed over the temporary storage means for respectively condensing and temporarily storing the water vapor and a low boiling portion of the other volatile components having a highest boiling point which is lower than the boiling point of water, the reservoir being operatively connected to said pyrolitic conversion chamber for transferring the condensed high boilers to the pyrolitic conversion chamber.

4. The stove according to claim 3 wherein the condenser means further comprises first condenser temperature control means for maintaining the first condenser and condensed high boilers at a temperature above the boiling points of water.

5. The stove according to claim 3 further comprising a rectifier means disposed in the stored condensable fraction transfer means for removing water from the condensable fraction being transferred from said temporary storage device to said combustion region.

6. The stove according to claim 5 wherein said rectifier means comprises a heated rectifying chamber and a temperature sensitive bypass valve, the temperature sensitive bypass valve remaining closed at temperatures below the boiling point of water and opening at temperatures equal to or exceeding the boiling point of water, whereby low boilers in the condensable fraction having boiling points less than the boiling point of water will be vaporized in said rectifier and transferred to said combustion region for incineration while water will be bypassed through the temperature sensitive bypass valve.

7. The stove according to claim 4 wherein the first condenser temperature control means comprises a temperature sensor located in the reservoir and a temperature controller connected to the temperature sensor for controlling a rate of heat transfer to or from the condenser in response to the temperature measured by the temperature sensor.

8. The stove according to claim 7 further comprising louvers wherein the condenser is surrounded by an ambient atmosphere and a space to be heated and said louvers are disposed between the condenser and the space to be heated, and wherein the first temperature controller controls opening and closing of said louvers whereby the rate of heat transfer from the condenser to the ambient atmosphere in the heated space and the temperature of the condenser and condensed high boilers is controlled.

9. The stove according to claim 7 wherein the means for generating a controlled draft of air through the fuel in said pyrolitic conversion chamber comprises a damper disposed in the gaseous transfer means and the first condenser temperature controller controls opening and closing of the damper in the gaseous transfer means whereby the rate of heat transfer to said condenser from the condensed high boilers is controlled thereby controlling the temperature of the condenser and condensed high boilers.

10. The stove according to claim 7 further comprising louvers wherein the condenser is surrounded by an ambient atmosphere andd a space to be heated and said louvers are disposed between the condenser and the space to be heated and the means for generating a controlled draft of air through the fuel in said pyrolitic conversion chamber comprises a damper disposed in the gaseous transfer means wherein the temperature controller controls opening and closing of said louvers and controls the opening and closing of the damper in the gaseous transfer means whereby the rate of heat transfer from the condenser to the ambient atmosphere in the heated space, and the rate of heat transfer to said condenser from the condensed high boilers is controlled thereby controlling the temperature of the condenser and condensed high boilers.

11. The stove according to claim 1 wherein the means for generating a controlled draft of air through the fuel in said pyrolitic conversion chamber comprises a damper disposed in the gaseous transfer means.

12. The stove according to claim 1 further comprising a rectifier means disposed in the stored condensable fraction transfer means for removing water from the condensable fraction being transferred from said temporary storage device to said combustion region.

13. The stove according to claim 12 wherein said rectifier means comprises a heated rectifying chamber and a temperature sensitive bypass valve, the temperature sensitive bypass valve remaining closed at temperatures below the boiling point of water and opening at temperatures equal to or exceeding the boiling point of water, whereby low boilers in the condensable fraction having boiling points less than the boiling point of water will be vaporized in said rectifier and transferred to said combustion region for incineration while water will be bypassed through the temperature sensitive bypass valve.

14. The stove according to claim 1 wherein the temporary storage means in said temporary storage device comprises an absorber.

15. The stove according to claim 1 wherein said pyrolitic conversion chamber is disposed adjacent to said combustion region, said pyrolitic conversion chamber having a bottom which slopes toward said combustion region and wherein the means for transferring the essentially volatiles free wood fuel from said pyrolitic conversion chamber to said combustion region comprises an aperture at the base of said chamber adjacent to said combustion region.

16. The stove according to claim 15 wherein said aperture comprises a slot and a guillotine-like means for adjusting the size of the slot.

17. The stove of claim 1, further comprising heat transfer means located adjacent said condensing means and in heat transfer communication therewith and with a space to be heated for transferring heat from said condensing means to said space.

* * * * *